United States Patent [19]

Bleckman

[11] Patent Number: 4,738,311

[45] Date of Patent: Apr. 19, 1988

[54] HEAT EXCHANGER

[76] Inventor: Ingo Bleckman, Ignaz-Rieder-Kai 11, A-502 Salzburg, Austria

[21] Appl. No.: 919,790

[22] Filed: Oct. 16, 1986

[30] Foreign Application Priority Data

Oct. 25, 1985 [DE] Fed. Rep. of Germany ... 8530313[U]
Jan. 20, 1986 [DE] Fed. Rep. of Germany ... 8601296[U]

[51] Int. Cl.[4] ..... F28D 7/02

[52] U.S. Cl. ..... 165/165; 165/78; 165/171; 165/172

[58] Field of Search ..... 165/165, 171, 172, 177, 165/78

[56] References Cited

U.S. PATENT DOCUMENTS

| | | | |
|---|---|---|---|
| 1,961,070 | 5/1934 | Murphy | 165/171 |
| 3,305,008 | 2/1967 | Jacobs | 165/179 X |
| 3,486,489 | 12/1969 | Huggins | 165/177 X |
| 3,627,039 | 12/1971 | Tiefenbacher | 165/165 X |
| 4,383,499 | 5/1983 | Rackham et al. | 165/165 X |
| 4,470,452 | 9/1984 | Rhodes | 165/179 X |

FOREIGN PATENT DOCUMENTS

| | | | |
|---|---|---|---|
| 10499 | 4/1980 | European Pat. Off. | 165/165 |
| 62972 | 7/1955 | France | 165/165 |
| 1213890 | 4/1960 | France | 165/165 |
| 617005 | 1/1949 | United Kingdom | 165/165 |

*Primary Examiner*—Albert W. Davis, Jr.
*Assistant Examiner*—Richard R. Cole
*Attorney, Agent, or Firm*—Philip A. Mallinckrodt; Robert R. Mallinckrodt

[57] ABSTRACT

A heat exchanger for use for example in a laundry dryer comprises a plurality of plates defining flow passages therebetween for a first heat exchange medium. Each plate is made up of a plurality of aluminum elements having mutually co-operating positive and negative profilings at their narrow sides, to fit snugly together. The plates are held at a spacing from each other in grooves in end wall members forming a holding assembly. A second heat exchange medium flows through the hollow interiors of the elements making up the plates. The hollow interiors have web portions therein, to enhance heat flow between the first and second heat exchange media.

17 Claims, 3 Drawing Sheets

HEAT EXCHANGER

BACKGROUND OF THE INVENTION

Heat exchangers such as condensation-type heat exchangers are required in large numbers, for example for laundry dryers, with such a heat exchanger construction comprising a large number of individual plates which are arranged at a spacing from each other. The plates are held in the assembled condition by a suitable form of holding means. By virtue of their spaced relationship, the plates form between them passages for a first heat exchange medium. Thus for example in a laundry dryer, as indicated above, the process air which has a high level of moisture contained therein is passed through the free spaces between the respective plates. As the plates are hollow, they define hollow spaces extending therethrough, through which for example cooling air is then blown in the context of a laundry dryer. The surfaces of the plates thus form condensation surfaces on which the moisture contained in the air flowing through the passages between the plates is accordingly deposited.

As, from the physics point of view, the transfer of heat from the cooling air side of the heat exchanger has a crucial influence on performance of the heat exchange process, a present arrangement of a heat exchanger, besides the hollow spaces referred to above, which are smooth, additionally has small strips of aluminium sheet which are secured in position as by glueing, thus giving additional heat exchange surfaces. Although the fact that the additional heat exchange surfaces are glued in position on the cooling side of the heat exchanger increases the level of efficiency thereof, that does however give rise to the consideration that the strips have to be stuck in position, which is a disadvantage from the manufacturing process point of view. Furthermore, the heat dissipation effect of such additional heat exchange surface portions is also checked or obstructed at the adhesive joins so that, in the present state of the adhesive art, it is necessary to glue a very large number of additional heat exchange surface portions in position in the heat exchanger arrangement. That in turn results in a high level of induced flow resistance, whereby the danger of clogging due to impurities and contaminatory material in the cooling air, which cannot be dissipated, is substantially increased. Over a service life of at least ten years, it is not impossible that the adhesive joins would have to be changed.

SUMMARY OF THE INVENTION

An object of the present invention is to provide an improved heat exchanger construction, for example for a laundry dryer.

Another object of the present invention is to provide a heat exchanger which is of a strong mechanical construction while affording a high level of heat exchange efficiency.

Still another object of the invention is to provide a heat exchanger assembly so designed that it can be built up from individual mass-produced components.

A further object of the invention is to provide a heat exchanger which gives a satisfactory heat exchange effect while being of small and compact size.

In accordance with the principles of the present invention, these and other objects are achieved by a heat exchanger comprising a holding means, with a plurality of hollow plates which are held at mutual spacings in the holding means, thereby defining between adjacent said plates passage means for a first heat exchange medium. Each plate comprises a plurality of individual elements and each element, in the interior thereof, has a substantial number of spaced-apart and mutually parallel web portions which extend across the hollow interior of the respective plate. The web portions interconnect the top and bottom side portions of the individual element, with an undisturbed heat flow through the metal thereof. The web portions thus form parallel guide passages for a second heat exchange medium which thus flows through the respective plates.

In a preferred embodiment of the invention, each element has a positive and a negative profile respectively at oppositely disposed narrow sides thereof, for example the positive profile being of a convex configuration and the negative profile being of a concave configuration, whereby each two adjacent elements mutually interfit by way of the positive and negative profiles. A plurality of such interfitting elements thus make up an individual plate of the heat exchanger. Each plate is arranged in the heat exchanger assembly in such a way that the positive profile of the end one of the elements making up each respective plate faces in the opposite direction to the incoming flow of the first heat exchange medium. The web portions preferably extend in at least substantially parallel relationship to the narrow sides of the plates.

In a further preferred embodiment of the invention, the hollow elements with the web portions therein and with further guide web portions which extend parallel to the web portions but which do not extend entirely across the space between the top and bottom side portions of the element, comprise an aluminum member.

In a preferred feature of the invention, the holding means comprises end walls of a suitable material such as a plastic material, with grooves at the mutually facing inside surfaces of the end walls, with the hollow elements being fitted into respective ones of the grooves in the end walls.

As indicated above, disposed between the web portions forming the interconnection between the top and bottom sides of the individual elements are guide web portions for guiding a flow of air therethrough. The guide web portions extend inwardly from the top and bottom side portions respectively of the hollow element, and extend across the spacing therebetween, over approximately one third thereof.

In another embodiment of the invention, where the holding means comprise two shaped bars at respective sides or ends of the heat exchanger assembly, with the above-mentioned grooves provided therein to accommodate respective ends of the individual elements making up the respective plates of the heat exchanger assembly, the projection portions which are thus defined between the respectively adjacent grooves have slots therein, to facilitate insertion of the hollow elements into the grooves, while in addition over a substantial part of their lengths, the grooves have preferably slot-like inlet and outlet openings for the flow of the second heat exchange medium through the plates.

Preferably, the holding means have guide surfaces for guiding the flow of the second heat exchange medium, with the guide surfaces being disposed in front of the respective openings of each of the guide passages between the plates and being arranged at an inclined angle with respect to the direction in which the guide passages extend.

Preferably, disposed in association with, such as behind, the openings of the above-mentioned guide passages for carrying the flow of the first heat exchange medium, the top side portion and/or the bottom side portion of each individual element of the respective plates has inwardly extending depression or dent-like configurations providing a constriction means reducing the cross-section of the respective guide passages, thereby to enhance turbulence in the flow of air flowing through the guide passages, to increase the heat exchange efficiency.

In another preferred embodiment, the above-mentioned guide surfaces for the second heat exchange medium are formed by connecting plate portions which bridge across the space defined between guide bar members, of which one accommodates the upper edge of an individual element and the other accommodates the lower edge thereof.

In accordance with a further preferred feature of the invention, each of the positive profiles of the foremost or end element which is at the end of the heat exchanger assembly at which the incoming flow of the first heat exchange medium passes into the heat exchanger assembly is directed inclinedly against the incoming flow of the heat exchange medium.

The shaped aluminum members may be fixed in the holding means in any suitable manner as by adhesive means or by a wedging or mechanical clamping effect.

Further objects, features and advantages of a construction in accordance with the principles of the present invention will be apparent from the following description of a preferred embodiment thereof.

DESCRIPTION OF THE PREFERRED EMBODIMENT

Figure 1:
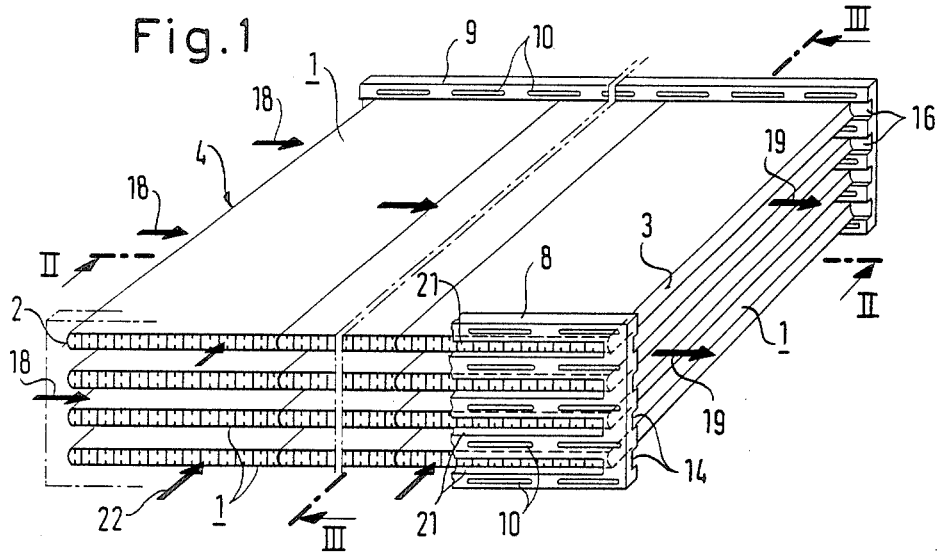
FIG. 1 is a cut-away perspective view of an embodiment of the heat exchanger according to the invention.
Figure 2:
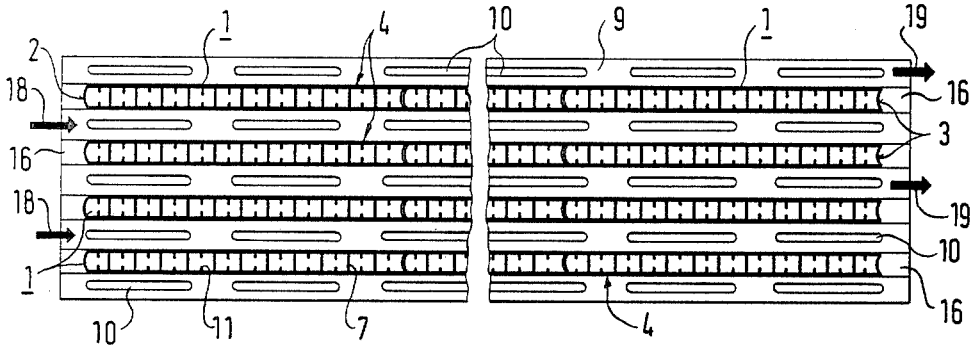
FIG. 2 is a view in section taken along line II—II in FIG. 1.
Figure 3:
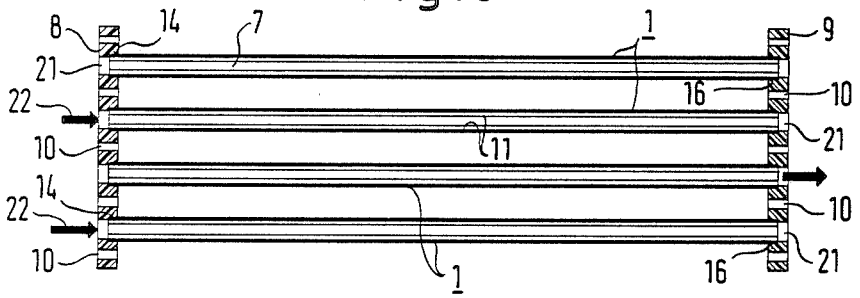
FIG. 3 is a view in section taken along line III—III in FIG. 1.

Referring firstly to FIGS. 1 through 3, a heat exchanger in accordance with the present invention comprises a plurality of plate-like hollow elements 1 which, as can be clearly seen from FIGS. 1 and 2, have a positive arcuate profiling at 2 at one narrow end or side and a negative arcuate profiling as indicated at 3 at the oppositely disposed side or end. Each element 1 thus has, in the illustrated embodiment, a convex configuration at one side at 2, and a concave configuration at the other side, at 3. As can be clearly seen from FIG. 2, the hollow elements 1 can thus be fitted together with the convex configuration 2 on one element 1 cooperating with and interfitting with the concave configuration 3 of the adjacent element 1. The hollow elements 1 which are produced on a mass-production basis, for example in the form of a continuous aluminum shaped member from which the desired length of element 1 is cut, are successively fitted into respective guide grooves 14 and 16 respectively which are provided in respective shaped bar members or end walls 8 and 9 forming a holding means for holding the elements 1 in the condition as illustrated for example in FIG. 1. The end walls 8 comprise a suitable material, preferably a plastic material. To assemble the construction shown in FIG. 1, the adjoining ends of a plurality of elements 1 are fitted into the grooves for example at 14 in the end wall 8, and then the other end wall 9 is fitted to the other ends of the elements 1, so that those other ends thus fit into the respective grooves 16 in that end wall 9. The elements 1 which, as indicated, may suitably comprise shaped aluminum members, may be fixed in the grooves 14 and 16 respectively as by adhesive means or by being caulked or wedged therein, or likewise held by a mechanical gripping effect.

Referring to FIG. 3, it will be seen therefrom that each of the end walls 8 and 9 has slots 10 between the respectively adjacent guide grooves 14 and 16. When the elements 1 are being pushed into the respective grooves 14 and 16 for accommodating same, the slots 10 permit a resiliently yielding movement of the end wall portions between the guide grooves 14 and 16, and thus make it easier to fit the elements 1 into position therein.

As shown in FIG. 1, a first heat exchange medium which is to be handled in the heat exchanger assembly according to the invention is introduced in the direction indicated by the arrows 18 in FIGS. 1 and 2, into the spaces defined between the hollow elements 1, and is removed from the heat exchanger assembly again, after having been in heat exchange relationship with a second heat exchange medium, in the direction indicated by the arrows 19. It will be seen from FIG. 1 that the plurality of elements 1 provide respective plates which are held by the holding means 8 and 9 and which define between them respective passages for the flow of the first heat exchange medium therefrom.

It will be seen from FIGS. 1 and 2, at the left-hand side thereof, that the heat exchange medium which enters the assembly in the directions indicated by the arrows 18 first encounters a positive or convex profiling 2 on the first element 1 at that end of the respective plates making up the heat exchanger assembly. The fact that the heat exchange medium impinges on a smoothly curved convex profile in that way provides for a smooth flow and thus a corresponding increase in flow speed.

While the first heat exchange medium flows between the plates formed by the elements 1, in the directions indicated by the arrows 18 and 19, the second heat exchange medium is introduced into the heat exchanger assembly in such a way as to flow through the hollow interiors of the respective plates formed by the pluralities of individual elements 1 which thus form parallel guide passages for the second heat exchange medium. Thus, looking at FIG. 3, the second heat exchange medium which may be for example cooling air is blown through the hollow interiors of the elements 1 in the direction indicated by the arrow 22, passing into and out of the elements 1 by way of slot-like inlet and outlet openings 21 respectively.

Figure 4:
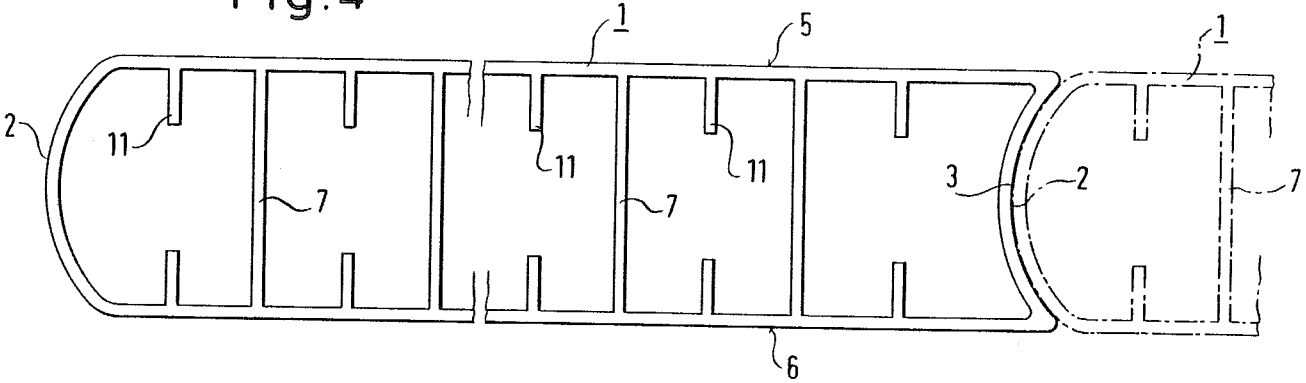
FIG. 4 is a view on an enlarged scale and in section through a first embodiment of a plate-like hollow element.
Figure 5:
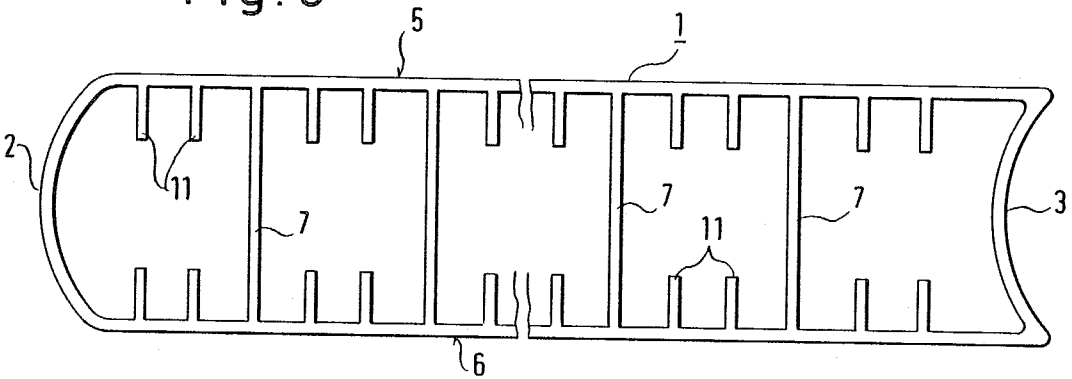
FIG. 5 is a view in section similar to that shown in FIG. 4 through a second embodiment of a plate-like hollow element.
Figure 6:
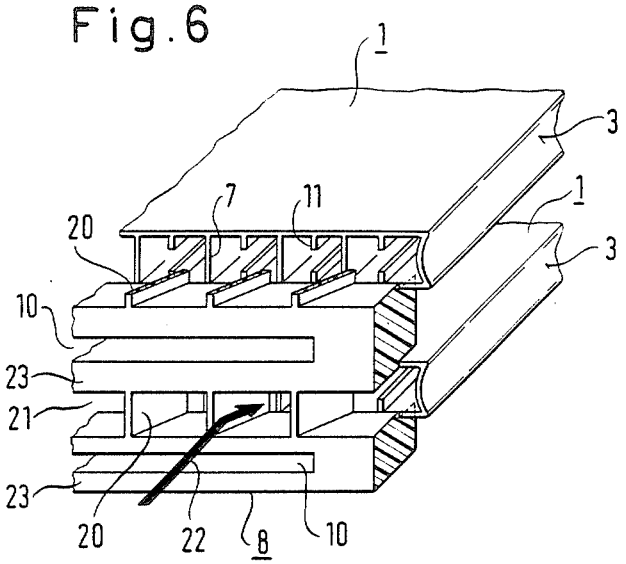
FIG. 6 is a view on an enlarged scale of part of the heat exchanger, showing the guide surfaces which produce an inclined incoming flow of air.

Looking now at FIG. 2 and also FIGS. 4 and 5, it will be seen that each of the hollow elements 1 is defined by a top side portion 5 and a bottom side portion 6. Extending between and interconnecting the top and bottom side portions 5 and 6 in each element 1 is a plurality of spaced-apart and mutually parallel web portions which on the one hand substantially improve the strength and stability of the elements 1; on the other hand, the cooling air flowing through the passages defined within the elements 1 draws heat from the web portions 7, as the cooling air flows along the surfaces thereof. It will be appreciated that the web portions interconnect the top and bottom side portions 5 and 6 of each individual element 1, as part of a one-piece construction which thus affords an uninterrupted flow of heat between the top and bottom side portions 5 and 6 and the web portions 7. It will be noted that the flow of the first heat exchange medium is over the outside surfaces of the top and bottom side portions 5 and 6 of the elements 1 while the flow of the second heat exchange medium is through the spaces defined between the web portions 7. Heat to be transferred from one heat exchange medium to the other thus finds a ready flow path through the top and bottom side portions 5 and 6 and the web portions 7. It will be seen therefore that the direct conduction of heat, through the metal of the portions 5 and 6 and the web portions 7, being uninterrupted by any form of adhesive join or the like as referred to above, gives a higher degree of operating efficiency. That means that fewer web portions or like members are required in the flow space through which the heat exchange medium flows, so that the level of resistance and also the danger of clogging of the heat exchanger assembly are substantially reduced.

The following dimensions are specified as a preferred example of construction of the heat exchanger of this invention:

- spacing between the profilings 2 and 3: 115 millimeters
- length of the plate-like hollow element 1: 235 millimeters
- height of the plate-like hollow element 1: 8 millimeters
- number of web portions 7 or air guide chambers in the hollow element 1: 18 or 19 respectively.

The above-defined heat exchanger construction can therefore be produced without any operation of making a large number of adhesive joints or other similar working operations. The hollow elements 1 only need to be pushed into position in their respective receiving grooves 14 and 16; in that respect, the grooves 14 and 16 are somewhat narrower than the height of the respective elements 1 so that the grooves 14 and 16 are resiliently expanded somewhat by virtue of the insertion of the elements 1 therein, such expansion being promoted by the existence of the slots 10, with the result that the hollow elements 1 are correspondingly gripped in position in the grooves 14 and 16. The transfer of heat is considerably improved in comparison with conventional heat exchangers of the same size.

The mutual interengagement and interfitting of the profilings 2 and 3 on the elements 1 gives a high level of stability and strength for the overall construction so that it is sufficient for the plates formed by the elements 1 to be held in the holding means constituted by the end walls 8 and 9. Furthermore, the construction of the invention provides a smooth surface for the array of plates, without hindrance to the flow of the first heat exchange medium through the guide passages defined therebetween.

It will be seen from FIGS. 4 and 5 that the arrangement according to the invention may further comprise additional guide web portions as indicated at 11 in FIGS. 4 and 5. FIG. 4 shows a construction having a single guide web portion 11 disposed in such a way as to project from the inside surface of each of the top and bottom side portions 5 and 6 respectively, between each two adjacent web portions 7. It will be seen that each of the guide web portions 11 projects inwardly from the respective surface of the top or bottom side portion 5 and 6, over about one third of the spacing therebetween. In FIG. 5, there are two guide web portions 11 arranged in mutually adjacent relationship on each of the top and bottom side portions 5 and 6, between each two adjacent web portions 7.

Figure 7:
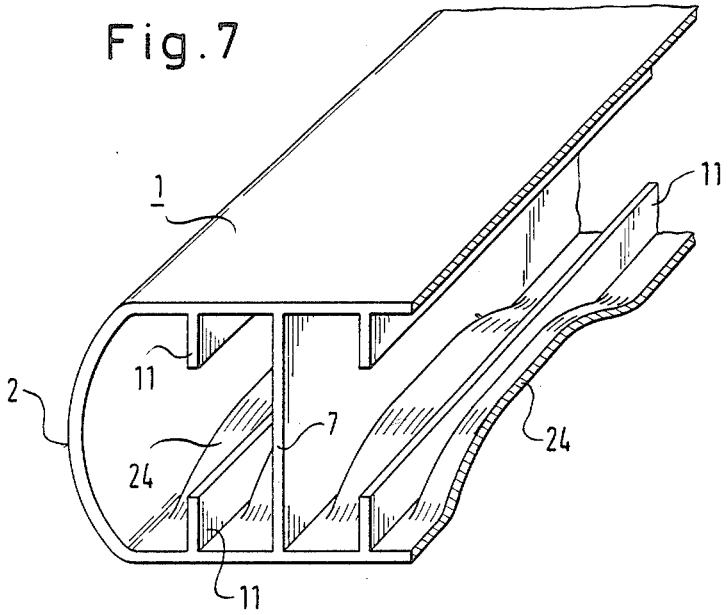
FIG. 7 is a perspective view on an enlarged scale showing the constriction portions which promote turbulence in the incoming flow of air.

The end walls 8 and 9 which include the grooves 14 and 16 for accommodating the respective ends of the elements 1 and which preferably comprise a suitable plastic material further have guide bar members 23 which are connected by plate portions 20 disposed inclinedly with respect to the longitudinal axis of the web portions 7. The flow of air which goes in in the direction indicated by the arrow 22 is blown by the plate portions 20 inclinedly on to the web portions 7 and the guide web portions 11, thus producing at the intake side a strong turbulence effect in the air which is further promoted by the inwardly extending depressions or dent means as indicated at 24 in FIG. 7, which deflect the air upwardly in the respective guide passage through which it is flowing, by virtue of the constriction effect produced thereby.

Suitable tests under practical conditions have shown that the transfer of heat between the two heat exchange media is considerably improved by the above-described construction, which makes it possible to build smaller heat exchangers with the same level of efficiency or to achieve a higher level of efficiency with heat exchangers of the same size.

It will be appreciated that the above-described embodiment has been set forth solely by way of example of the present invention which is not restricted thereto and that various other modifications and alterations may be made therein without thereby departing from the spirit and scope of the invention. For example, in place of a single constriction means 24 in each flow passage, it would be possible to provide a plurality of for example hemispherical constriction portions at spacings from each other, which extend as far as the middle of the individual plate element or even therebeyond.

What is claimed is:

1. A heat exchanger, comprising holding means; a plurality of hollow plates held at mutual spacings in said holding means, thereby defining, between adjacent plates, passage means for a first heat exchange medium, each plate comprising an element having first and second spaced-apart wall portions defining said hollow interior thereof and in its said interior having a number of web portions arranged in spaced-apart and mutally parallel relationship and interconnecting said first and second wall portions for an undistrubed metal-borne heat flow therethrough, said plates having convex leading edges faces confronting flow of said first heat exchange medium into said passage means therebetween for substantially undisturbed entry of said first heat exchange medium into said passage means, and said web portions forming parallel guide passages for a second heat exchange medium; inlet outlet openings in said holding means for flow of said second heat exchange medium into and out of said guide passages, respectively; and turbulence effecting means disposed in entrance portions of said guide passages to cause turbulence of the inflowing second heat exchange medium for enhancing heat transfer.

2. A heat exchanger as set forth in claim 1 wherein said web portions extend in at least substantially parallel relationship to said narrow sides of said plates.

3. A heat exchanger as set forth in claim 1 wherein each said element with said first and second wall portions and said web portions comprises an aluminum member.

4. A heat exchanger as set forth in claim 1 and further including at least one further guide web portion extending partly across the interior of said element between each two adjacent web portions.

5. A heat exchanger as set forth in claim 4 wherein guide web portions for the flow of air between said interconnecting web portions project from the first and second wall portions respectively of each said element in an inward direction, and each bridge over substantially one third of the spacing between same.

6. A heat exchanger as set forth in claim 1 wherein said holding means comprise end walls at respective ends of said elements and each said end wall is provided at the mutually oppositely disposed inside surfaces with groove means into which the end portions of said elements are fitted.

7. A heat exchanger as set forth in claim 1 wherein said elements are aluminum members fixed in the holding means by adhesive.

8. A heat exchanger as set forth in claim 1 wherein said elements are aluminum members fixed in said holding means by a wedging effect.

9. A heat exchanger as set forth in claim 1, wherein the said turbulence effecting means comprises constriction means in the form of inwardly extending depressions or dent means in the inlet portions of the said guide passages.

10. A heat exchanger as set forth in claim 1, wherein the said turbulence effecting means comprises deflecting means at the entrances of said guide passages for deflecting the incoming second heat exchange medium.

11. A heat exchanger, comprising holding means; a plurality of hollow plates held at mutual spacings in said holding means, thereby defining, between adjacent plates, passage means for a first heat exchange medium, each plate comprising a plurality of individual elements, and each element having first and second spaced-apart wall portions defining said hollow interior thereof and in its said interior having a number of web portions arranged in spaced-apart and mutually parallel relationship and interconnecting said first and second wall portions for an undisturbed metal-bone heat flow therethrough, said web portions forming parallel guide passages for a second heat exchange medium, and wherein said holding means comprise end walls at respective ends of said elements and each said end wall is provided at the mutually oppositely disposed inside surfaces with groove means that are separated by projection portions and into which the end portions of said elements are fitted, and wherein said end walls of said holding means comprise first and second shaped bar members, the projection portions which are defined between said groove means have slots therein, and said groove means over a large part of the length thereof form slot-like inlet and outlet openings for said second heat exchange medium.

12. A heat exchanger as set forth in claim 11, wherein said end walls are resilient so as to facilitate the fitting of the end portions of said elements into said groove means.

13. A heat exchanger as set forth in claim 12 wherein the said walls of the said holding means include slots therein for augmenting the resilience of said walls.

14. A heat exchanger assembly as set forth in claim 11 wherein each said end wall member has a plurality of grooves adapted to accommodate respective ends of said individual elements making up said respective plates, the width of each said groove being so adapted in relation to the corresponding dimensions of the respective individual element that each said individual element is gripped in the respective groove, thereby to be securely held in position therein.

15. A heat exchanger, comprising holding means; a plurality of hollow plates held at mutual spacings in said holding means, thereby defining, between adjacent plates, passage means for a first heat exchange medium, each plate comprising a plurality of individual elements, and each element having first and second spaced apart wall portions defining said hollow interior thereof and in its said interior having a number of web portions arranged in spaced-apart and mutually parallel relationship and interconnecting said first and second wall portions for an undisturbed metal-borne heat flow therethrough, said web portions forming parallel guide passages for a second heat exchange medium, and further including guide surface means for said second heat exchange medium disposed on said holding means, said guide surface means being disposed in front of the respective inflow openings of said guide passages and being arranged at an inclined angle with respect to the direction in which said guide passages extend.

16. A heat exchanger as set forth in claim 15 wherein at least one of the underside and the top side of said passages in said individual elements, behind said openings of said guide passages, has inwardly extending portions reducing the cross-section of said guide passages.

17. A heat exchanger as set forth in claim 15, and further including guide bar members, each of which accommodates the upper edge of an individual element and the lower edge of an adjacent element, and wherein said guide surface means are formed by connecting plate members which bridge the space between said guide bar members and serve as a turbulence effecting means.

* * * * *